United States Patent [19]

Nishimura

[11] Patent Number: 4,960,979

[45] Date of Patent: Oct. 2, 1990

[54] ELECTRICALLY HEATABLE SHEET PREPARED BY PAPER

[76] Inventor: Makoto Nishimura, Burume Omori Rooms No. 705, 3-10-10, Omori Nishi, Ota-ku, Tokyo, Japan

[21] Appl. No.: 358,546

[22] Filed: May 26, 1989

[30] Foreign Application Priority Data

Dec. 6, 1988 [JP] Japan ..... 63-307016
Dec. 6, 1988 [JP] Japan ..... 63-307017

[51] Int. Cl.[5] ..... H05B 3/34
[52] U.S. Cl. ..... 219/549; 252/511
[58] Field of Search ..... 219/553, 549, 548; 338/212, 210, 225; 252/511, 510; 162/138

[56] References Cited

U.S. PATENT DOCUMENTS 4,115,917 9/1978 Charon et al. ..... 219/549
4,250,397 2/1981 Gray et al. ..... 219/549
4,816,184 3/1989 Fukuda et al. ..... 252/511
4,874,548 10/1989 Hajovsky ..... 252/511

*Primary Examiner*—Roy N. Envall, Jr.
*Attorney, Agent, or Firm*—Limbach, Limbach & Sutton

[57] ABSTRACT

An electrically heatable sheet contains 3 to 20% by weight of carbon fibers and 97 to 80% by weight of natural pulp. The carbon fibers consist of at least two groups of different lengths, each of the carbon fibers of one group having a length of not shorter than 3 mm and shorter than 5 mm, each of the carbon fibers of the other group having a length of not shorter than 5 mm and not longer than 10 mm. The carbon fibers is selected from the group consisting of pitch type carbon fibers, polyacrylonitrile type carbon fibers and mixtures thereof. The sheet has a thickness of not thicker than 150 μm and a basis weight of not larger than 55 g/m$^2$.

12 Claims, 1 Drawing Sheet

ELECTRICALLY HEATABLE SHEET PREPARED BY PAPER

BACKGROUND OF THE INVENTION

This invention relates to an electrically heatable sheet prepared by paper making technique using carbon fibers, and a method for preparing the same.

In the prior art, there are a variety of proposals with respect to an electrically heatable sheet containing carbon fibers and adapted to be utilized in, for example, floor heaters, horticultural equipments, bedding, health appliances or cattle sheds. For example, there is disclosed in Japanese Unexamined Patent Publication No. 18702/1975 a paper-like composition containing acrylonitrile type synthetic resin pulp and carbon fibers. This paper-like composition lacks in practical utilities since the carbon fibers cannot be mixed and entangled uniformly such that the electrical resistance of the electrically heatable sheet formed of the paper-like composition is not uniform and hence the sheet cannot be increased in size.

There is also disclosed in Japanese Unexamined Patent Publication No. 281293/1987 an electrically heatable sheet containing short cut carbon fibers and natural pulp, wherein the fiber surface is coated at least partially by solid contents of a viscous or glueing agent. This prior-art sheet contains the solid contents of the glueing agent as the essential component for improving dispersibility of the carbon fibers and entanglements between the carbon fibers and natural fibers. However, there is a limit to the amount of the solid contents of the glueing agent in the composition such that the carbon fibers cannot be dispersed sufficiently and the electrical resistance cannot be rendered uniform throughout the electrically heatable sheet. Also the carbon fibers are not entangled sufficiently in the sheet so that it is difficult to raise the sheet temperature to a temperature of higher than 50° C. Moreover, as the carbon fibers employed in the electrically heatable sheet are cut previously to a predetermined size, it takes much time until the fibers are dispersed in the sheet. In addition, the fiber size may become discrete due to fiber breakage at the time of dispersion, resulting in insufficient entanglement and non-uniform electrical resistance and temperature. For improving the mechanical strength of the sheet, it is proposed to coat and seal both sides of the electrically heatable sheet with a plastic film or sheet. Although the tensile strength of the sheet can be increased in this manner by the sole proposal of the prior art, the bending strength of the sheet may be lowered, while the usage of the sheet is also restricted. That is, only the sheet surface is coated, while the structure of the sheet itself is not improved, and disadvantages are presented since the sheet itself may be destitute in pliability by such coating treatment of the sheet surface.

On the other hand, in the electrically heatable sheet employing plant or natural pulp, disadvantages are also presented in connection with the thermal resistance of the sheet itself, such that the sheet temperature cannot be raised to a temperature of higher than 60° C. and particularly to a temperature of higher than 100° C., while temperature characteristics are extremely unstable at higher temperatures.

In the meanwhile, although silver paste electrodes have been used as the electrodes for the electrically heatable sheet, the heating temperature may be varied depending on the mounting positions of these electrodes, so that electrically heatable sheet as a whole cannot be maintained at a constant temperature. There is also an additional disadvantage that, when the electrical resistance of the sheet disposed between the electrodes is lower than the electrical resistance of the electrode itself, the electrode may be heated to evolve heat.

SUMMARY OF THE INVENTION

It is a principal object of the present invention to provide a lightweight electrically heatable sheet which is prepared by paper making technique using carbon fibers, and a method for producing the same, wherein the sheet has highly stable electrical resistance and temperature characteristics and superior mechanical strength while presenting significant economic advantages.

It is another object of the present invention to provide a flexible electrically heatable sheet which is prepared by paper making technique using carbon fibers, and a method for producing the same, wherein the sheet has superior strength and thermal resistance while exhibiting stable temperature characteristics at higher temperatures.

It is still another object of the present invention to provide an electrically heatable sheet which is prepared by paper making technique using carbon fibers, and a method for producing the same, wherein the sheet not only emits heat but also radiates far infrared rays.

The above and other objects will become apparent from the following description.

In accordance with the present invention, there is provided an electrically heatable sheet comprising 3 to 20 % by weight of carbon fibers and 97 to 80 % by weight of natural pulp, the carbon fibers consisting of at least two groups of different lengths, each of the carbon fibers of one group having a length of not shorter than 3 mm and shorter than 5 mm, each of the carbon fibers of the other group having a length of not shorter than 5 mm and not longer than 10 mm, the carbon fibers being selected from the group consisting of pitch type carbon fibers, polyacrylonitrile type carbon fibers and mixtures thereof, the sheet having a thickness of not thicker than 150 μm and a basis weight of not larger than 55 g/m$^2$.

In accordance with the present invention, there is also provided a method for producing an electrically heatable sheet comprising mixing and dispersing a starting material comprising 3 to 20 % by weight of carbon fibers and 97 to 80 % by weight of natural pulp for forming the material into a sheet having a thickness of not thicker than 150 μm and a basis weight of not larger than 55 g/m$^2$, the carbon fibers consisting of at least two groups of different lengths, each of the carbon fibers of one group having a length of not shorter than 3 mm and shorter than 5 mm, each of the carbon fibers of the other group having a length of not shorter than 5 mm and not longer than 10 mm, the carbon fibers being selected from the group consisting of pitch type carbon fibers, polyacrylonitrile type carbon fibers and mixtures thereof.

PREFERRED EMBODIMENTS OF THE INVENTION

Figure 1:
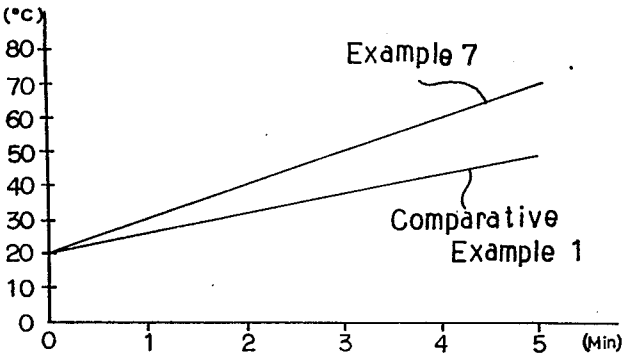
FIG. 1 is a chart showing the results of a test of conducting electrical currents carried out in Test Example 1.

The present invention will be explained hereinbelow in more detail.

The electrically heatable sheet containing carbon fibers according to the present invention containing pitch type carbon fibers and/or polyacrylonitrile (PAN) type carbon fibers as essential components, wherein the carbon fibers consist of at least two groups of different lengths, each of the carbon fibers of one group having a length of not shorter than 3 mm and shorter than 5 mm, and preferably not shorter than 3.5 mm and not longer than 4.5 mm, each of the carbon fibers of the other group having a length of not shorter than 5 mm and not longer than 10 mm, and preferably not shorter than 6 mm and not longer than 9 mm. With use of only one kind of carbon fibers each having a constant length, it is difficult to disperse the carbon fibers uniformly in the electrically heatable sheet. When a mass of the starting material is stirred for long time for dispersing the fibers, the fibers may be broken to indefinite sizes so that stable electrical resistance or temperature characteristics are not obtained. In addition, since the fibers are broken in this manner, the extent of fiber entanglement and hence the strength of the produced sheet are lowered. With the length of the carbon fibers of shorter than 3 mm, the extent of entanglement of these carbon fibers with the other carbon fibers and natural fibers is lowered. With the length of the carbon fibers longer than 10 mm, dispersibility of the carbon fibers into the natural pulp is lowered, resulting in the non-uniform distribution of the carbon fibers and in the unstable electrical resistance and temperature characteristics. Although the diameter of the carbon fibers is not particularly limited, it is preferred that the diameter be 4 to 10 μm, particularly 6 to 8 μm in consideration of the dispersibility. The pitch and/or PAN type carbon fibers are preferably highly elastic carbon fibers having the tensile strength of the order of 200 to 800 kg/mm$^2$. The pitch type carbon fibers, inter alia, may preferably include liquid crystal pitch type carbon fibers produced by a process including a hydrogenating step.

The natural pulp employed in the present invention is preferably selected from one or more of wood fibers, such as needle-leaf trees or broad-leaf trees, seed wool fibers such as cotton or kapok, bast fibers such as mitsumata, paper mulberry, a kind of daphne odora, mulberry tree, jute, flax, hemp, China grass or ramie, leaf fibers such as Manila hemp or sisal, fibers of the Graminede family fibers, such as rice plant straws, rice hulls, bamboo, bagasse or esparto.

Although a mixture of natural pulp with a synthetic pulp obtained by spinning synthetic resin fibers obtained in turn by polymerizing one or more monomers selected from acrylonitrile, vinyl acetate, vinyl chloride, vinylidene chloride, (meth)acrylic acid or (meth)acrylate, (meth)acrylamide, styrene, vinylpyridine, vinyl compounds containing sulfone or salts thereof, allyl compounds containing sulfone and salts thereof, and vinyl alcohol, may be employed, natural pulp is preferably employed by itself in view of costs and strength. The diameters of the natural pulp and the synthetic pulp may preferably be 100 μm or smaller, most preferably 10 to 80 μm in view of dispersibility although not limited to these ranges.

According to the present invention, the relative contents of the pitch type carbon fibers and/or PAN type carbon fibers and the natural pulp are such that the pitch type carbon fibers and/or PAN type carbon fibers account for 3 to 20 % by weight and preferably 8 to 12 % by weight and the natural fibers account for 97 to 80 % by weight. With the contents of the pitch type carbon fibers and/or PAN type carbon fibers less than 3 % by weight, the electrical resistance is increased and the desired heating temperature cannot be realized. With the contents in excess of 20 % by weight, the rate of dispersion is lowered and the stable electrical resistance and temperature characteristics cannot be obtained.

The electrically heatable sheet of the present invention has a thickness of not thicker than 150 μm and preferably in the range of from 10 to 100 μm and a basis weight of not larger than 55 g/m$^2$ and preferably in the range of from 10 g/m$^2$ to 36 g/m$^2$. With the thickness in excess of 150 μm or the basis weight in excess of 55 g/m$^2$, the sheet per se may undergo interlayer peeling or be destitute in pliability.

For improving the strength and the thermal resistance of the electrically heatable sheet per se of the present invention, there may be impregnated a resin having a thermal deformation temperature of not lower than 60° C., preferably of not lower than 100° C. in view of thermal resistance. Examples of the resins having the thermal deformation temperature of not lower than 60° C. may include for example phenol resin, urea resin, melamine resin, polyester, epoxy resin, diallylphthalate resin, vinyl chloride resin, polystyrene, SAN resin, ABS resin, methyl methacrylate resin, polypropylene, polyamide, polyacetal, polycarbonate, polyphenylene oxide, poly(4-methylpentene-1) and mixtures thereof.

According to the present invention, for further increasing the strength of the electrically heatable sheet containing carbon fibers or the electrically heatable sheet additionally containing the resin having the thermal deformation temperature of not lower than 60° C., the sheet may be additionally coated by a coating material selected from the group consisting of woven fabrics, non-woven fabrics and synthetic fibers. The synthetic fibers may include, for example, polyester fibers, acrylic fibers and mixtures thereof.

Figure 3:
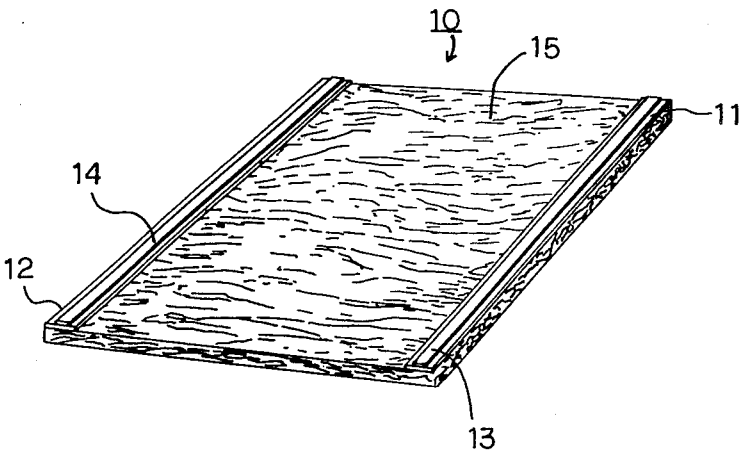
FIG. 3 is a perspective view showing the electrically heatable sheet of the present invention with electrodes of an electrically conductive paste and auxiliary electrodes of metal foils.

As shown in FIG. 3, the heating temperature of the sheet 10 may be stabilized by at least two electrodes 11, 12 of electrically conductive paste and applied to two opposite sides of the sheet and two auxiliary electrodes 13, 14 of metal foils bonded along the lengths of the electrodes 11, 12. With the use only of the electrodes 11, 12 formed of electrically conductive paste, as in the conventional sheet, the electrode itself may be heated to evolve heat when the electrical resistance of the electrodes becomes smaller than that of the sheet 15 disposed between the electrodes. This inconvenience may be avoided by the above described arrangement of the present invention. More than two electrodes formed of electrically conductive paste may be employed, provided that these electrodes are mounted for facing to each other. These electrodes may be designed for reducing the electrical resistance to as small a value as possible in dependence upon the size and shape of the sheet per se.

When the electrodes are bonded to both side edges of the sheet and one more electrode is bonded to the sheet at an equidistant position from these side edges, the distance between the adjacent electrodes may be reduced for lowering the electrical resistance between the electrodes to maintain a higher heating temperature. The electrically conductive paste may be enumerated by gold, silver, copper, nickel or aluminum paste, or mixtures thereof. The metal foil may be enumerated by, for example, aluminum, copper, nickel, stainless steel or mixtures thereof.

For preparing the electrically heatable sheet according to the present invention, the different length groups of the pitch type carbon fibers and/or PAN type carbon fibers and the natural pulp are mixed and dispersed for forming a sheet of a predetermined thickness by application of paper making technique. For such mixing and dispersion, the aforementioned groups of different lengths of the pitch type carbon fibers and/or PAN type carbon fibers and the natural pulp are caused to flow in circulating water preferably for 10 to 50 minutes and more preferably for 20 to 30 minutes using a well-known pulper or the like stirrer. Alternatively, the aforementioned groups of different lengths of the pitch type carbon fibers and/or PAN type carbon fibers and the natural pulp are dispersed separately in water, after which they are mixed and again dispersed in water. At this time, defoaming agents such as silicone, ester compounds, paraffin waxes, mineral oils or polyalkylenes and/or drier peeling agents such as polyethylene, wax or silicone type agents may be added to the system, if so desired. For producing a sheet from a starting solution in which the aforementioned pitch type carbon fibers and/or PAN type carbon fibers and the natural pulp are mixed and dispersed in water, the starting solution may be processed by the paper making technique to produce a sheet of desired thickness and basis weight using a well-known cylinder or Yankee machine or a fourdrinier machine.

For impregnating the resin having the thermal deformation temperature of not lower than 60° C. in the electrically heatable sheet containing the carbon fibers, the sheet may be dipped for preferably 1 to 5 seconds in the resin having the thermal deformation temperature of not lower than 60° C., with the sheet being then dried as the resin thickness is controlled to a predetermined value by a doctor knife or a pressure roll. Alternatively, the sheet may be spray coated and thereby impregnated in the resin having the thermal deformation temperature of not lower than 60° C., or the resin having the thermal deformation temperature of not lower than 60° C. may be screen printed on both sides of the sheet. Still alternatively, the resin having the thermal deformation temperature of not lower than 60° C. may be formed into a film which is then applied under heating by a heated roll for impregnating the resin into the sheet. When the electrically heatable sheet is to be cut to size after impregnation thereof in the resin having the thermal deformation temperature of not lower than 60° C., it is preferred that the cut sides of the sheet be subjected to an electrical insulating treatment.

The electrically heatable sheet according to the present invention making use of the pitch type carbon fibers and/or PAN type carbon fibers of different lengths is superior in dispersibility to the conventional electrically heatable sheet, and provides a system in which these carbon fibers are strongly entwined with the natural pulp. By using auxiliary electrodes, it is possible to prevent heat evolution from the electrodes or to reduce the consumption of the electrical power, so that highly stable temperature characteristics may be achieved even when the size of shape of the sheet itself is increased or changed. In addition, an interlayer strength stronger than in the conventional product may be realized without employing any glueing agents. When the sheet is impregnated in the resin having the thermal deformation temperature of not lower than 60° C., the mechanical strength of the sheet may be improved while the pliability of the sheet is maintained. The sheet also has superior thermal resistance and highly stable temperature characteristics at higher temperatures, so that it may be employed in many fields of application or usages.

The sheet of the present invention also has superior dispersibility of the carbon fibers, a higher heating temperature may be achieved with a lesser power consumption than in the case of the conventional electrically heatable sheet. In other words, a lesser amount of the electrical power suffices to evolve the heat at the same temperature. An economical merit is derived since the fibers can be entwined with one another despite the lower contents of carbon fibers while the dispersion time can be reduced during preparation of the sheet. A practical merit is also derived that, when heated, the sheet of the present invention emits far infrared radiation rays.

EXAMPLES OF THE INVENTION

The present invention will be explained further with reference to the Examples, Comparative Examples and Test Examples. However, these Examples are given only by way of illustration and are not intended for limiting the scope of the invention.

EXAMPLE 1

0.125 g of PAN type carbon fibers of 8 mm in length, 1.188 g of Manila pulp and 0.90 g of kraft pulp (N-BKP) were charged into a small-sized test mixer, along with water, and were mixed and stirred for 10 seconds to disperse the components. Then, 0.125 g of the PAN type carbon fibers 4 mm in length were added to the contents of the mixer to mix and stir for 10 seconds. The liquid dispersion thus obtained was poured into a 250×250 mm tapping machine and formed into a sheet with a basis weight of 35 g/m$^2$. The sheet thus formed was passed through a drum drier to produce an electrically heatable sheet containing carbon fibers of 95 μm in thickness. The sheet was then cut to produce a test sheet piece of 200×200 mm in size and a test sheet piece of 20×20 mm in size, that is, of a size equal to one tenth of the former test piece size. A silver paste strip was bonded to each of two opposing sides of the sheet pieces and a copper foil auxiliary electrode was attached along the length of each silver paste strip to measure the electrical resistance of each sheet piece to find the difference of the two-dimensional relative resistance between these test pieces. The results are shown in Table 1.

Examples 2 to 8

Electrically heatable sheets were prepared in the same way as in Example 1 except that the relative amounts of the carbon fiber groups of different lengths were changed as shown in Table 1, and tests were conducted on test pieces. The results are also shown in Table 1.

Comparative Example 1

An electrically heatable sheet was prepared in the same way as in Example 1 except that 2.5 g of the PAN type carbon fibers of 8 mm in length was used and 1000 cc of a 0.001 % diluted starting polyethylene oxide solution was used as the glueing agent. The basis weight and the thickness of the produced electrically heatable sheet were 40 g/m$^2$ and 110 μm, respectively. The electrical resistance of the produced electrically heatable sheet was measured to find the difference of two-dimensional relative resistances of the two test pieces. The results are also shown in Table 1.

TABLE 1

| | 200 × 200 mm Sheet (Ω/□) | 20 × 20 mm Sheet (Ω/□) | Difference of Two Dimensional Relative Resistances (%) | Manila Pulp (54%) | N-BKP (Kraft Pulp) (36%) | Carbon Fiber 8 mm | Carbon Fiber 4 mm |
|---|---|---|---|---|---|---|---|
| Ex. 1 | 22.0 | 22.4 | 2 | 1.188 g | 0.90 g | 0.125 g (5%) | 0.125 g (5%) |
| Ex. 2 | 22.8 | 23.2 | 2 | 1.188 g | 0.90 g | 0.10 g (4%) | 0.15 g (6%) |
| Ex. 3 | 23.4 | 23.8 | 2 | 1.188 g | 0.90 g | 0.075 g (3%) | 0.175 g (7%) |
| Ex. 4 | 24.2 | 24.8 | 2.5 | 1.188 g | 0.90 g | 0.05 g (2%) | 0.20 g (8%) |
| Ex. 5 | 25.5 | 26.1 | 2.5 | 1.188 g | 0.90 g | 0.025 g (1%) | 0.225 g (9%) |
| Ex. 6 | 20.8 | 21.0 | 1 | 1.188 g | 0.90 g | 0.15 g (6%) | 0.10 g (4%) |
| Ex. 7 | 21.3 | 21.5 | 1 | 1.188 g | 0.90 g | 0.175 g (7%) | 0.075 g (3%) |
| Ex. 8 | 19.1 | 19.3 | 1 | 1.188 g | 0.90 g | 0.20 g (8%) | 0.05 g (2%) |
| Comp. Ex. 1 | 41.2 | 57.9 | 40 | 1.188 g | 0.90 g | 2.5 g (10%) | 0 g (0%) |

% in parentheses indicates % by weight of carbon fibers in the heatable sheet.

EXAMPLE 9

0.125 g of carbon fibers of 8 mm in length, 0.125 g of carbon fibers of 4 mm in length and 0.90 g of kraft pulp were charged into a small-sized test mixer, along with water, and were mixed and stirred for 10 minutes to disperse the various components in water. The resulting dispersion was poured into a 250×250 mm tapping machine to produce a sheet having a basis weight of 40 g/m$^2$ and a thickness of 110 μm.

The produced sheet was cut to a size of 200×200 mm and polyamide hot melt films produced by Nippon Mathai Co., Ltd. under the trade name of "Elfan-NT180" were applied by a heated roll at the temperature of 180° C. on both sides of the sheet to produce a polyamide-impregnated electrically heatable sheet. The electrical resistance of the produced electrically heatable sheet was then measured and found to be 22.0 (Ω/□). The sheet was then rounded suitably by hand and, after the forces were applied to the rounded sheet from many directions, the sheet was restored to its original shape and the electrical resistance of the sheet was measured. It was found that the electrical resistance was almost unchanged from the value measured prior to force application. The sheet was then placed on a piece of an insulating material and the temperature was raised to 200° C. at room temperature of 20° C. and at a voltage of 100 V to measure the changes in the temperature for one hour. It was found that the temperature was almost unchanged for the one hour testing period.

Test Example 1

Each of the test pieces of the electrically heatable sheets prepared in Example 7 and Comparative Example 1 was placed on a piece of an insulating material and subjected to a test of current conduction for five minutes at room temperature of 20° C. and a voltage of 24 V. The results are shown in the chart of FIG. 1.

Test Example 2

Figure 2:
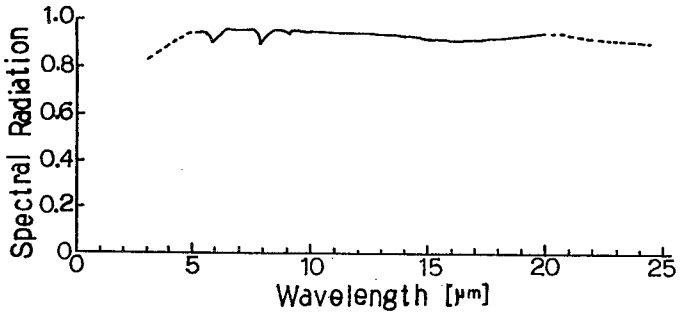
FIG. 2 is a chart showing the results of a test of radiation of far infrared rays carried out in Test Example 2.

The test piece of the electrically heatable sheet of 200×200 mm in size, produced in Example 1, was heated to a surface temperature of 38° C. at room temperature of 21.5° C. to measure the spectral radiation and wavelength. It was found that about 100 % of the far infrared radiation rays having the wavelength of 5 to 20 μm were radiated from the test piece. The results of measurement are shown in the chart of FIG. 2.

It may be seen from the above Examples and the Comparative Example that the electrically heatable sheet of the present invention exhibits a lower electrical resistance and a lower difference of two-dimensional relative resistances than in the conventional sheet, while the carbon fibers per se are dispersed more satisfactorily. It is also seen from the Test Examples that the rise in temperature at the same voltage is the room temperature plus 30° C. in the conventional sheet and the room temperature plus 50° C. in the sheet of the present invention, so that the heating temperature equal to 1.67 times that obtained in the conventional sheet may be achieved in the inventive sheet.

Although the present invention has been described with reference to the specific examples, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. An electrically heatable sheet comprising 3 to 20 % by weight of carbon fibers and 97 to 80 % by weight of natural pulp, said carbon fibers consisting of at least two groups of different lengths, each of the carbon fibers of one group having a length of not shorter than 3 mm and shorter than 5 mm, each of the carbon fibers of the other group having a length of not shorter than 5 mm and not longer than 10 mm, said carbon fibers being selected from the group consisting of pitch type carbon fibers, polyacrylonitrile type carbon fibers and mixtures thereof, said sheet having a thickness of not thicker than 150 μm and a basis weight of not larger than 55 g/m$^2$.

2. The electrically heatable sheet according to claim 1 wherein said carbon fibers are highly elastic carbon fibers having a tensile strength of 200 to 800 kg/mm$^2$,

3. The electrically heatable sheet according to claim 1 wherein said natural fibers are selected from the group consisting of needle-leaf trees, broad-leaf trees, cotton, kapok, mitsu-mata, paper mulberry, a kind of daphne odora, mulberry tree, jute, flax, hemp, China grass, ramie, Manila hemp, sisal, rice plant straws, rice hulls, bamboo, bagasse, esparto or mixtures thereof.

4. The electrically heatable sheet according to claim 1 wherein the sheet further contains a synthetic pulp.

5. The electrically heatable sheet according to claim 4 wherein said synthetic pulp is obtained by spining synthetic resin fibers prepared by polymerization of monomers selected from the group consisting of acrylonitrile, vinyl acetate, vinyl chloride, vinylidene chloride, (meth)acrylic acid, (meth)acrylate, (meth)acrylamide, styrene, vinylpyridine, vinyl compounds containing sulfone and salts thereof, allyl compounds containing sulfone and salts thereof, vinyl alcohol, and mixtures thereof.

6. The electrically heatable sheet according to claim 1 wherein the sheet is impregnated with a resin having a thermal deformation temperature of not lower than 60° C.

7. The electrically heatable sheet according to claim 6 wherein the resin having the thermal deformation temperature of not lower than 60° C. is selected from the group consisting of phenol resin, urea resin, melamine resin, polyester, epoxy resin, diallylphthalate resin, vinyl chloride resin, polystyrene, SAN resin, ABS resin, methyl methacrylate resin, polypropylene, polyamide, polyacetal, polycarbonate, polyphenylene oxide, poly(4-methylpentene-1) and mixtures thereof.

8. The electrically heatable sheet according to claim 1 wherein the sheet is coated by a coating material selected from the group consisting of woven fabrics, non-woven fabrics and synthetic fibers.

9. The electrically heatable sheet according to claim 6 wherein the sheet is coated by a coating material selected from the group consisting of woven fabrics, non-woven fabrics and synthetic fibers.

10. The electrically heatable sheet according to claim 1, 6, 8 or 9 wherein the sheet is provided with at least two opposing paste electrodes of electrically conductive paste and auxiliary electrodes of metal foil lying along the lengths of said paste electrodes.

11. The electrically heatable sheet according to claim 10 wherein said paste is selected from the group consisting of gold paste, silver paste, copper paste, nickel paste, aluminum paste and mixtures thereof.

12. The electrically heatable sheet according to claim 10 wherein said metal foil is selected from the group consisting of aluminum, copper, nickel, stainless steel and mixtures thereof.

* * * * *